US006120313A

United States Patent [19]

Luich et al.

[11] Patent Number: 6,120,313

[45] Date of Patent: Sep. 19, 2000

[54] CONNECTOR BODIES WITH HIGH FORCE POSITIONING MECHANISM

[75] Inventors: Shawn W Luich, Niles; Mark J Vanden Wymelenberg, Girard, both of Ohio

[73] Assignee: Delphi Technologies, Inc., Troy, Mich.

[21] Appl. No.: 09/232,299

[22] Filed: Jan. 15, 1999

[51] Int. Cl.[7] ..... H01R 13/627

[52] U.S. Cl. ..... 439/362

[58] Field of Search ..... 439/152, 153, 439/157, 296, 310, 359, 362, 368, 953

[56] References Cited

U.S. PATENT DOCUMENTS 3,999,830 12/1976 Herrmann, Jr. et al. ..... 439/610
4,008,939 2/1977 Kinkaid et al. ..... 439/264
5,486,122 1/1996 Oda et al. ..... 439/752
5,733,137 3/1998 Knoop ..... 439/362

*Primary Examiner*—Khiem Nguyen
*Assistant Examiner*—Brian S. Webb
*Attorney, Agent, or Firm*—Patrick M. Griffin

[57] ABSTRACT

The subject invention discloses a connector body positioning mechanism that pulls a pair of connector bodies together, against a high resistance force, to a fully seated position. A cam crank axially retained to one connector body turns in a plane normal to the direction of relative connector body motion, drawing a pair of helical grooves along an opposed pair of projections in the other connector body. A releasable latch retains the cam crank in a postion that properly registers the grooves and projections. Turning the handle back breaks the connection with the same highly leveraged force.

8 Claims, 5 Drawing Sheets

CONNECTOR BODIES WITH HIGH FORCE POSITIONING MECHANISM

TECHNICAL FIELD

This invention relates to positioning assist mechanisms for connector bodies of the type which have a relatively high connection resistance.

BACKGROUND OF THE INVENTION

Connector bodies, especially in the automotive field, often incorporate multiple individual electrical pin or blade and socket terminal pairs, which are axially inserted together concurrently with the connector bodies at assembly. Each of the individual pairs has a certain frictional resistance that results from the tight insertion force needed to maintain a solid electrical interconnection, and the sum total of all of these creates a high net mechanical resistance. Generally, a snap fit latch of some sort clicks into place when the connector bodies are fully seated, which indicates that all the terminal pairs have been fully seated. Some means to mechanically assist in drawing the connector bodies together to a fully seated position may be needed, beyond what a human assembler can provide through a standard manual pressing. Typically, one or more threaded fasteners may be used, which pull the connector bodies to a fully seated position when tightened. This requires an equal number of separate, tool assisted assembly operations, as well as requiring sufficient access for the tool. Another approach is a rocking or type of camming lever, such as that disclosed in U.S. Pat. No. 5,711,682, in which a lever moves in a "crow bar" action, from an up to a down position, and in the same general direction as the axial seating motion of the connector bodies, to draw them together There will be instances where there is not sufficient room to package a cam lever long enough to provide sufficient mechanical advantage.

SUMMARY OF THE INVENTION

The invention provides a position assist mechanism in which the tool is effectively built into and incorporated with the connector bodies, and which provides a simple, compact, and highly leveraged, mechanically assisted seating force at assembly.

In the preferred embodiment disclosed, a first and second connector body, when aligned and axially moved together to a fully seated position, experience a high resistance force, as described above. The first connector body has a generally cylindrical barrel formed in it, coaxial to the axial direction in which the connector bodies move together. At least one cam follower projection protrudes radially inwardly into the barrel, with two diametrically opposed projections provided in the actual embodiment disclosed. A cam crank on the second connector body includes a cylindrical shank that projects unencumbered therefrom so as to be axially insertable into the barrel when the connector bodies are aligned. The cam crank is retained on the second connector body in such a wary that it and the shank are axially captured, but can be freely turned about the shank axis by a crank handle, which provides a significant moment arm, but which moves ninety degrees to the direction of connector body seating motion.

At least one helical camming surface is arrayed about the axis of the shank, two, in the embodiment disclosed, and both in the form of two opposed helical slots, one for each opposed cam follower projection. A barb on the second connector body releasably holds the cam crank handle in a position that assures registration between the respective slots and projections when the connector bodies are aligned and pushed partially axially together at assembly. At that point, turning the cam crank handle approximately half a turn pulls the projections through the helical slots, creating a highly leveraged axial force to pull the connector bodies fully together. The handle moves in a plane perpendicular to the direction of connector body motion, between ending and starting positions that both lie flat to the second connector body. In addition, in the embodiment disclosed, a second barb releasably retains the handle in the fully turned position. Since the helical slots are two sided, reversing the handle will push the connector bodies apart, as well.

DESCRIPTION OF THE PREFERRED EMBODIMENT

Figure 1:
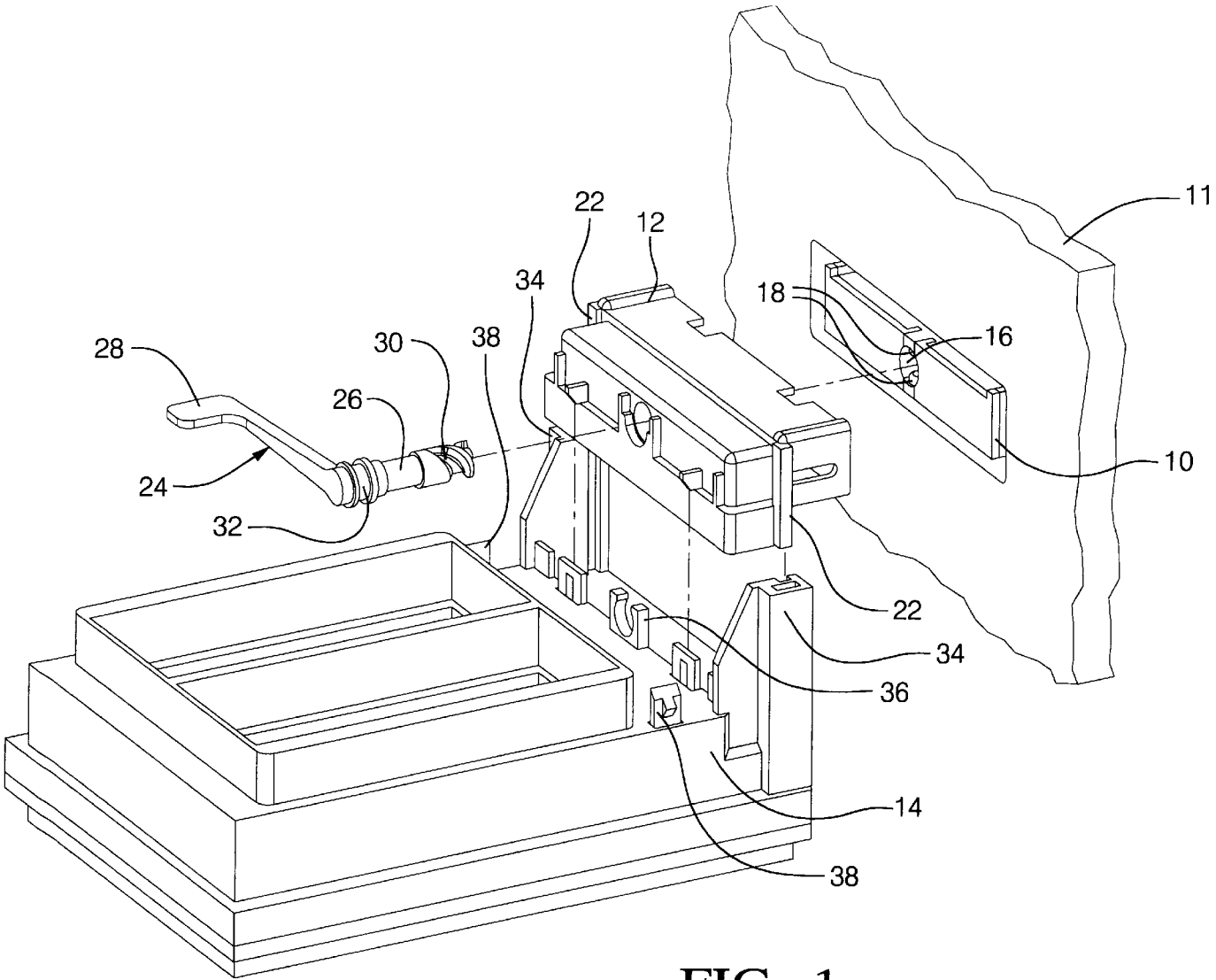
FIG. 1 is an exploded perspective view of the two connector bodies and cam crank disassembled.

Referring first to FIG. 1, a first connector body is indicated at 10. Many details of first connector body 10 are not specifically illustrated, but understood to be present in it and all like structures. Connector bodies like 10 are generally plastic molded, box like structures within which a plurality of male or female electrical connectors are contained. It should be understood that a connector body could be a subcomponent that is fixed to a larger structure, and that is in fact the case here, with connector body 10 being a female header connector that is, in turn, fixed to a larger computer control module 11, not illustrated in detail. In any case, a large number of tightly interfitting male and female electrical connectors will have to be moved axially together, creating a relatively high resistance force. The second connector body, too, is a composite of two subcomponents, a male header connector 12 and a larger electrical center 14 to which it is fixed. It is the male and female header connectors 12 and 10 that are first aligned and then drawn directly together by the assist mechanism of the invention.

Figure 4:
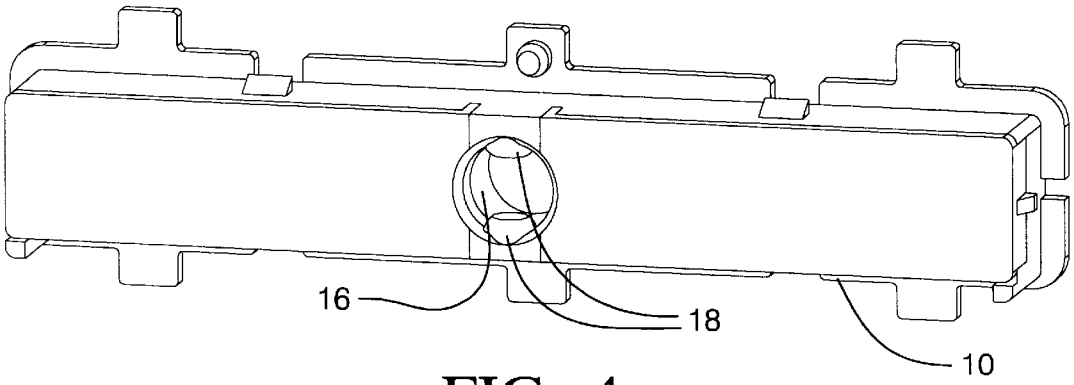
FIG. 4 is a perspective view of the front of the first connector body.
Figure 5:
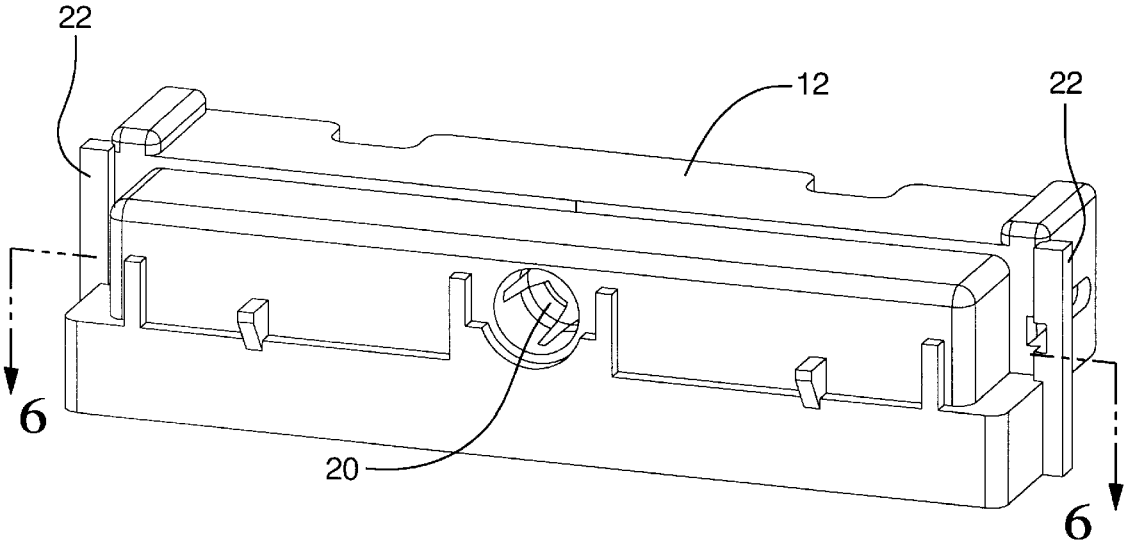
FIG. 5 is perspective view of a portion of the cam crank retention means on the second connector body.
Figure 6:
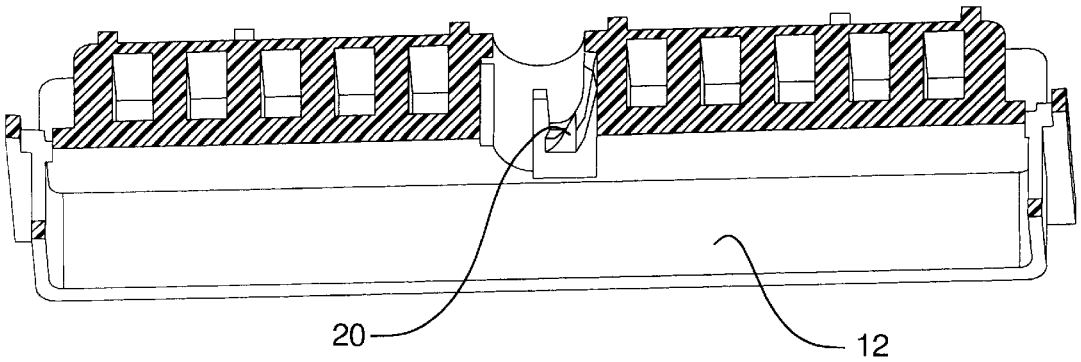
FIG. 6 is cross section of FIG. 5.

Referring next to FIGS. 4, 5 and 6, specific features of the connector bodies 10 and 12, which are involved in the operation of the invention, are described. A cylindrical barrel 16 is molded centrally into the female header connector 10, coaxial to the pull direction provided by the invention. A pair of diametrically opposed, generally conical projections 18 protrude slightly radially into the barrel 16, near the front opening thereof. A diametrically opposed pair of flexible fingers 20 on male header connector 12, best seen in FIG. 6, protrude slightly radially into the same cylinder defined by barrel 16, at least when the connector bodies 10 and 12 are aligned at assembly. A pair of guide rails 22 on the side of male header connector 12 provide for alignment to the electrical center 14, described in more detail below.

Figure 2:
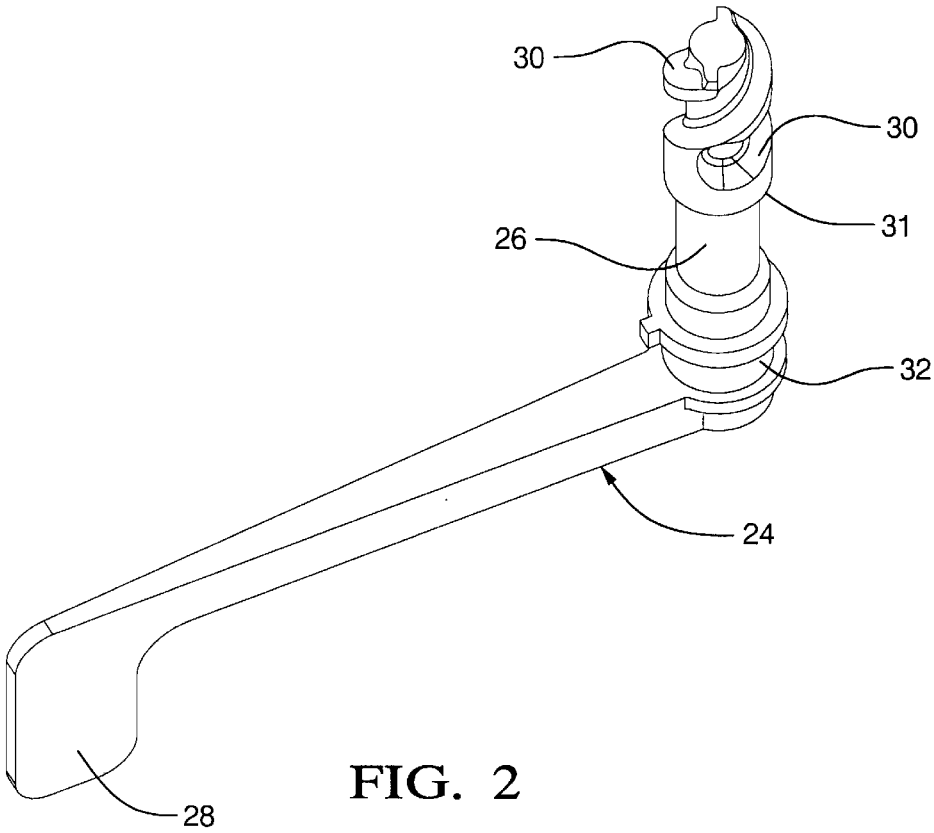
FIG. 2 is a perspective view of one side of the cam crank alone.
Figure 3:
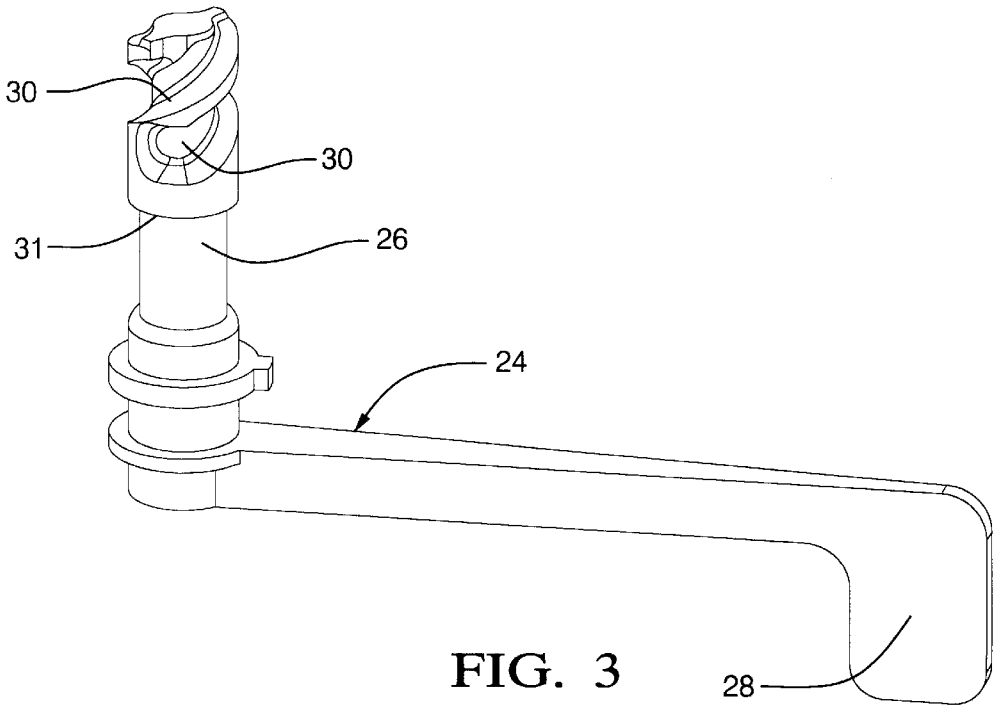
FIG. 3 is a perspective view of the other side of the cam crank.

Referring next to FIGS. 2 and 3, a one piece cam crank, indicated generally at 24, has a generally cylindrical forward shank 26 sized to be closely received within the barrel 16, and a rear handle 28 perpendicular to the axis of shank 26, and forming a significant crank arm with respect thereto, of some two and a half inches. A pair of opposed helical grooves 30 arrayed around the axis of shank 26 are each wide and deep enough to closely receive a respective projection 18. At the rear of shank 26, near the juncture with handle 28, is a complete circular notch 32.

Referring again to FIG. 1, additional structure on electrical center 14 cooperates with male header connector 12 and ultimately with cam crank 24. A pair of guide slots 34 interfit with the male header connector guide rails 22, allowing male header connect 12 to be inserted therein and down onto the top surface of electrical center 14 to, in effect, form a larger composite connector body. On the top surface of electrical center 14, an integrally molded yoke 36 forms a half circle that is coaxial to the ultimate location of cam crank shank 26. A pair of upstanding, integrally molded flexible barbs 38 straddle either side of the yoke 36, with a separation approximately equal to twice the length of cam crank handle 28.

Figures 7, 8:
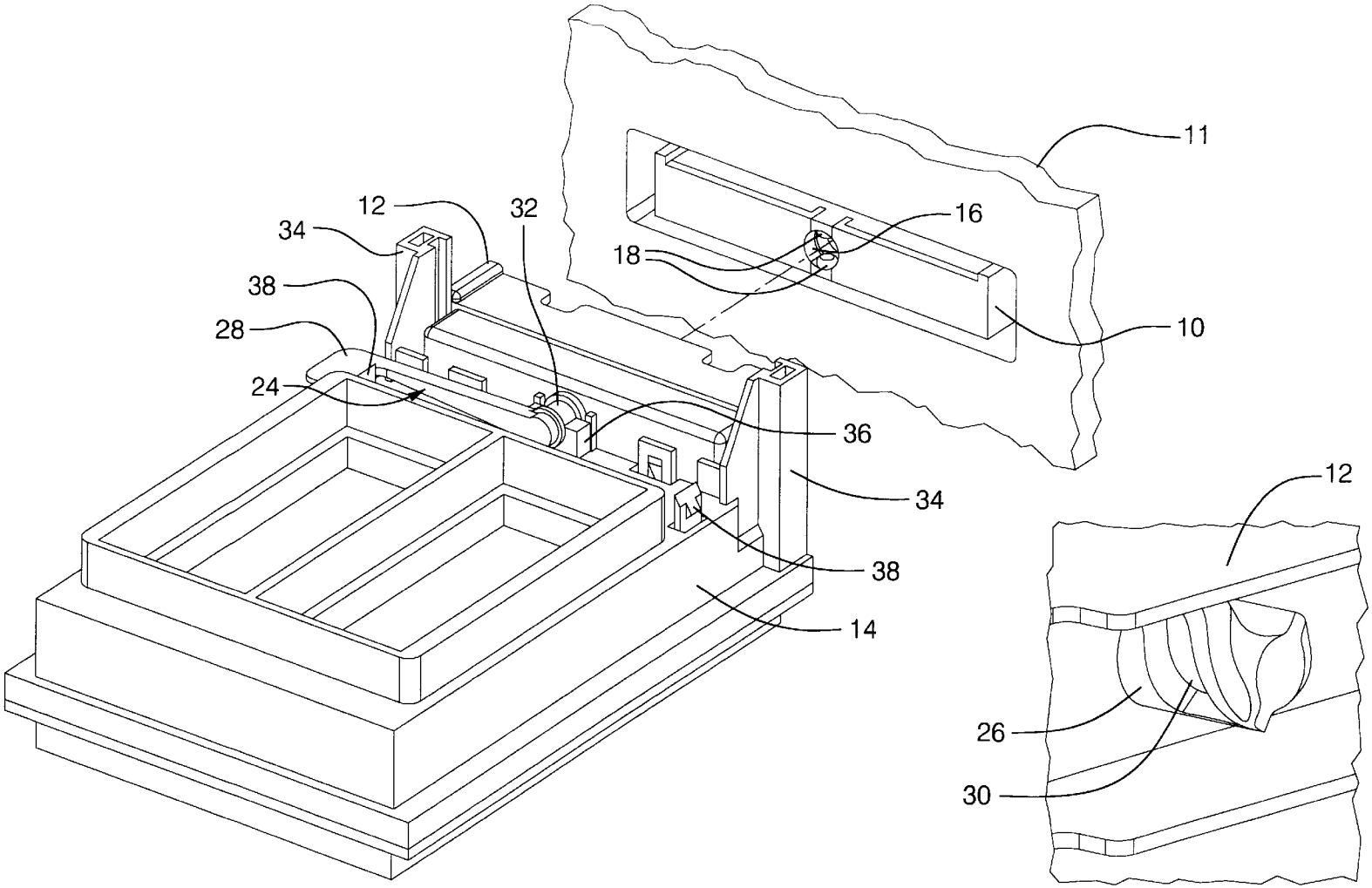
FIG. 7 is a perspective view of the second connector body with the cam crank retained thereto in an unlatched position, aligned with the first connector body
FIG. 8 is a view of the front of the second connector body, showing the projecting , unencumbered shank of the cam crank.

Referring next to FIGS. 7 and 8, the invention is assembled by first inserting the cam crank shank 26 through the front of male header connector 12 and between the flexible fingers 20 until they snap behind ledge 31. At that point, cam crank 24 is fully axially retained to male header connector 12, but can be freely turned back and forth about the axis of shank 26. With crank 24 installed to male header connector 12, the guide rails 22 are pushed down between the guide slots 34 until the male header connector 12 is fully seated against the top surface of the electrical center 14. As this occurs, male and female electrical connectors would engage between the two, as well. This is done prior to assembly into a vehicle, however, so there is no lack of access, and it is easy to apply as much pushing force as needed. A separate latch means is also provided between the two, so that they are fixed solidly together, in effect forming a single composite connector body. The installation of male header connector 12 to electrical center 14 also pushes the shank's circular notch 32 down into the yoke 36, thereby providing a redundant measure of axial retention of the cam crank 24 to the header connector 12-electrical center 14 composite connector body. Initially, the crank handle 28 is turned fully counterclockwise, as seen in FIG. 7, and releasably latched to one of the barbs 38. This establishes an unlocked position of the crank 24, with the helical grooves maintained in a fixed position. The barb 38 that establishes the unlocked position may be marked by a suitable symbol to visibly differentiate. It will be noted that the handle 28 lies flat to the upper surface of the electrical center 14, rather than sticking up, in its unlocked position. In addition, as best seen in FIG. 8, the shank 26 protrudes from the rear of male header connector 12, unencumbered over the entire length of the helical grooves 30.

Figure 9:
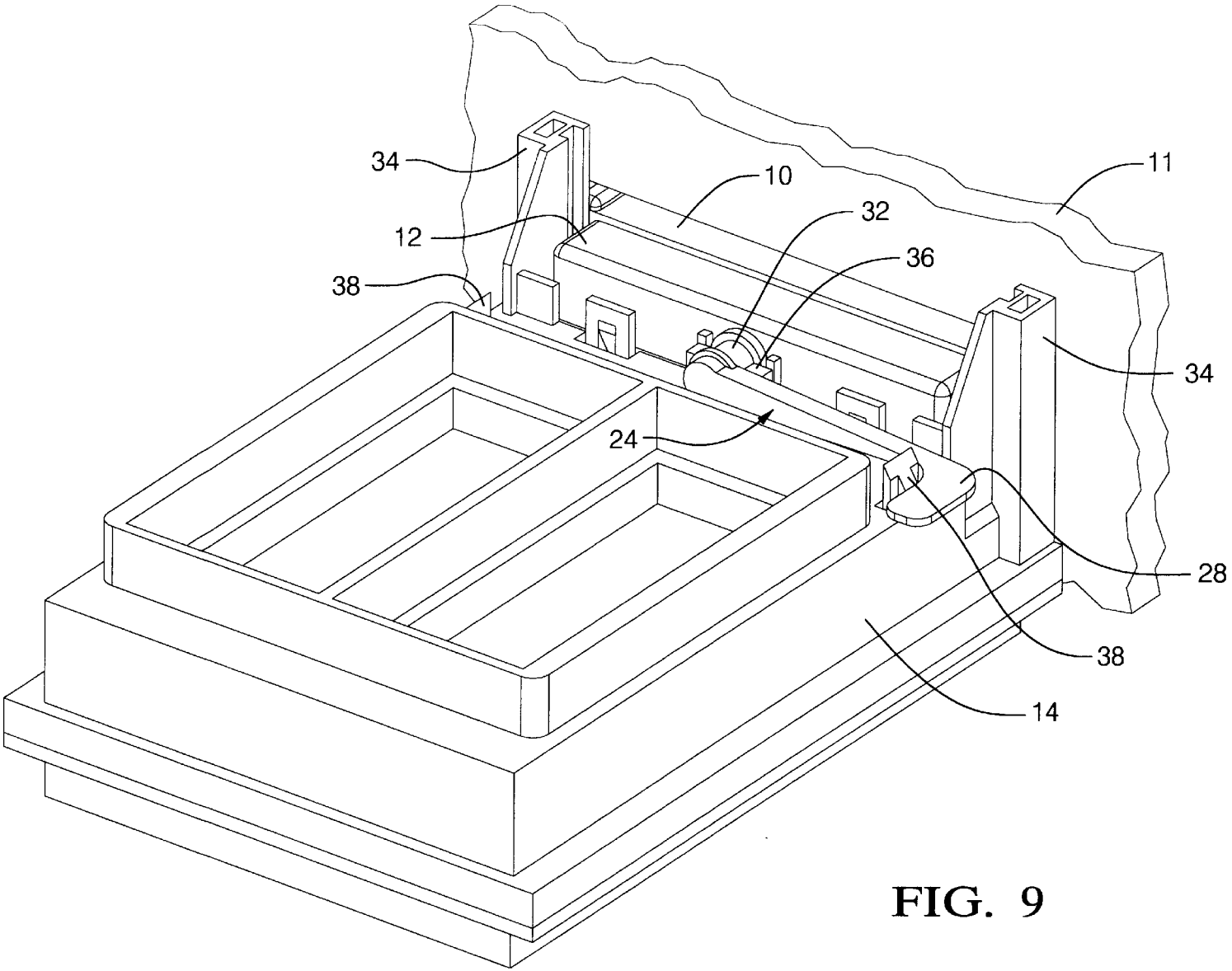
FIG. 9 shows the two connector bodies fully seated with the cam crank fully turned and locked in a latched position.

Referring finally to FIG. 9, the composite connector body of male header 12 and electrical center 14 is installed to the female header connector 10 by initially aligning it with, and axially pushing it partially onto, the female connector header 10. This may be referred to as "pre-staging" the parts. The frictional retention between 10 and 12 resulting from this initial "pre-staging" axial motion, if not sufficient to maintain temporary connection between the two, could be assisted by a low force intial latch. It should be noted that the low degree of pre staging insertion force is an advantage in that the female header connector 10 is not externally forced axially into or against any other part into which it may be incorporated, such as computer control module 11, minimizing the potential for damage. The degree of axial insertion motion involved during pre staging, while not enough to bring the male and female contact pairs into solid engagement, is enough to move the end of the protruding shank 26 partially axially into the barrel 16. Concurrently, each projection 18 moves into registration with a respective helical groove 30, because of the fixed position provided to shank 26 by the retention of handle 28 to the one barb 38. At that point, the handle 28 is turned approximately 180 degrees clockwise, in a plane normal to the axis of shank 26. Handle 28 finally latches to the other barb 38, establishing a locked position of handle 28, which also lies compact and flat to the upper surface of the electical center 14. So turning crank 24 and shank 26 pulls the helical grooves 30 along the projections 18, creating a highly leveraged axial force to pull the two header connectors 10 and 12 toward one another. The degree of force, and the axial extent of the helical grooves 30, are sufficient to pull the two header connectors 10 and 12 to a fully seated position, fully engaging all of the male-female electrical connector pairs. The force provided by the crank 24 is experienced only between the connector body pair 10–12, and is not transmitted to any other structure to which the connector body 10 may be secured. Since, in the embodiment disclosed, the helical grooves 30 are two sided, turning the handle 28 back provides an equal force to part the connector bodies 10 and 12.

Variations could be made in the disclosed embodiment. For example, only one helical camming surface equivalent to just the forward side surface of one helical groove 30, and only one projection equivalent to 18, could provide the axial seating force. Two such surfaces and projections provide a better balanced force, however, and a groove like 30, with both a forward and rear side surface, are convenient in that they provide the connection breaking action, in addition to the connection making action. As already noted, the yoke 36 and flexible fingers 20 provide a measure of redundancy in axially and turnably retaining the cam crank 24. This redundancy is a great convenience when the male header connector 12 and electrical center 14 are secured as shown to form one composite body, however, since the fingers 20 hold the crank 24 to the male header connector 12 initially. The barbs 38 could be eliminated, with the alignment or registration of the helical grooves 30 to the projections 18 being left up to the operator at the time of assembly, who could, by feel, rotate the crank 24 back and forth until they "caught" and pulled. However, it simplifies the assembly operation considerably to building the proper groove 30-projection 18 registration directly in to the structure. Therefore, it will be understood that it is not intended to limit the invention to just the embodiment disclosed.

What is claimed is:

1. A connector body positioning mechanism for pulling a pair of connector bodies axially together against a high resistance, comprising, a first connector body having a generally cylindrical barrel formed therein with at least one cam follower projection protruding radially inwardly therefrom, a cam crank having a generally cylindrical forward shank coaxially receivable within said barrel and at least one helical camming surface arrayed around said shank which registers with said cam follower projection when said shank is coaxially received within said barrel, said cam crank also having a rear handle extending generally perpendicular to said shank so as to create a moment arm relative to said shank, a second connector body that is axially insertable onto said first connector body, and, cam crank retention means on said second connector body to axially capture said cam crank thereon between said at least one helical camming surface and said rear handle for free turning about the shank axis with the shank projecting unencumbered therefrom, whereby said cam crank shank may be inserted coaxially within said barrel to bring said helical camming surface and cam follower projector into registration, after which turning said cam crank handle pulls said helical camming surface along said projection, thereby creating leveraged axial force, through said moment arm, to pull said connector bodies axially together against high resistance.

2. A connector body positioning mechanism according to claim 1, further characterized in that said barrel includes a pair of cam follower projections, and said shank includes a respective pair of helical camming surfaces.

3. A connector body positioning mechanism according to claim 2, further characterized in that said crank shank includes a pair of helical grooves arrayed around its axis.

4. A connector body positioning mechanism for pulling a pair of connector bodies axially together against a high resistance, comprising, a first connector body having a generally cylindrical barrel formed therein with a pair of cam follower projections protruding radially inwardly therefrom, a cam crank having a generally cylindrical forward shank coaxially receivable within said barrel and a pair of helical grooves arrayed around said shank which register with said pair of cam follower projections respectively when said shank is coaxially received within said barrel, said cam crank also having a rear handle extending generally perpendicular to said shank so as to create a moment arm relative to said shank, a second connector body that is axially insertable onto said first connector body, cam crank retention means on said second connector body to axially capture said cam crank thereon for free turning about the shank axis with the shank projecting unencumbered therefrom, and said second connector body further including means to retain said crank handle releasably latched in an initial position that maintains said helical grooves and projections in registration prior to connection to said first connector body whereby said cam crank shank may be inserted coaxially within said barrel to bring said helical grooves and cam follower projections into registration, after which turning said can crank handle pulls said helical grooves along said projections, thereby creating leverages axial force, through said moment arm, to pull said connector bodies axially together against high resistance.

5. A connector body positioning mechanism for pulling a pair of connector bodies axially together against a high resistance, comprising, a first connector body having a generally cylindrical barrel formed therein with at lest one cam follower projection protruding radially inwardly therefrom, a cam crank having a generally cylindrical forward shank coaxially receivable within said barrel and at least one helical canning surface arrayed around said shank which registers with said cam follower projection when said shank is coaxially received within said barrel, said cam crank also having a rear handle extending generally perpendicular to said shank so as to create a moment arm relative to said shank, a second connector body that is axially insertable onto said first connector body, cam crank retention means on said second connector body to axially capture said cam crank thereon for free turning about the shank axis with the shank projecting unencumbered therefrom, and said second connector body further including a means to retain said crank handle releasably latched in a initial position that maintains said helical camming surface and said cam follower projection in registration prior to connection to said first connector body whereby said cam crank shank may be inserted coaxially within said barrel to bring said helical camming surface and cam follower projector into registration, after which turning said cam crank handle pulls said helical camming surface along said projection, thereby creating leveraged axial force, through said moment arm, to pull said connector bodies axially together against high resistance.

6. The connector body positioning means according to claim 5, further characterized in that said cam crank retention means on said second connector body axially captures said cam crank between said at least one helical camming surface and said rear handle.

7. The connector body position means according to claim 5, further characterized in that said second connector body further includes means to retain said crank handle releasably latched in a locked position that fully seats the first and second connector bodies.

8. The connector body position means according to claim 6, further characterized in that said second connector body further includes means to retain said crank handle releasably latched in a locked position that fully seats the first and second connector bodies.

* * * * *